United States Patent [19]

Schaetzke et al.

[11] Patent Number: 4,604,883

[45] Date of Patent: Aug. 12, 1986

[54] MASS FLOW CONTROL SYSTEM FOR WIRE DRAWING MACHINE

[75] Inventors: William R. Schaetzke, Shrewsbury; Ronald W. DuFries, Westboro, both of Mass.

[73] Assignee: Morgan Construction Company, Worcester, Mass.

[21] Appl. No.: 788,745

[22] Filed: Oct. 17, 1985

[51] Int. Cl.[4] ..... B21C 1/10; B21C 1/12

[52] U.S. Cl. ..... 72/280; 72/289; 72/21; 242/47.01; 242/47.12; 242/78

[58] Field of Search ..... 72/280, 279, 289, 443, 72/21; 242/47.01, 47.12, 128, 78

[56] References Cited

U.S. PATENT DOCUMENTS

| | | | |
|---|---|---|---|
| 2,996,170 | 8/1961 | Bruestle | 72/289 |
| 3,796,385 | 3/1974 | Jacobsson | 242/47.01 |
| 3,938,751 | 2/1976 | Kawakami et al. | 242/47.01 |
| 4,247,057 | 1/1981 | Jacobsson | 242/47.01 |
| 4,529,017 | 7/1985 | Suzuki et al. | 242/47.01 |

*Primary Examiner*—Daniel C. Crane

*Attorney, Agent, or Firm*—Thompson, Birch, Gauthier & Samuels

[57] ABSTRACT

A mass flow control system for a wire drawing machine wherein wire is drawn through a die by a rotating block driven by a variable speed motor. The thus drawn wire is accumulated as a plurality of windings on the block before being removed therefrom via a guide. The guide is arranged on a carrier ring which rotates independently of the block about the axis of block rotation when a difference exists between the rates at which wire is wound onto and removed from the block. The control system includes a motion detector for generating electrical signals representative of the direction and speed of rotation of the carrier ring. Controls associated with the drive motor and responsive to the aforesaid signals adjust the rotational speed of the block in order to reach a steady state condition where wire is being wound onto and removed from the block at the same rate, and the carrier ring remains motionless.

6 Claims, 8 Drawing Figures

MASS FLOW CONTROL SYSTEM FOR WIRE DRAWING MACHINE

BACKGROUND OF THE INVENTION

1. Field of the Invention

This invention relates to an improved control system for maintaining a substantially constant mass flow of wire through the successive stations of a continuous cumulative wire drawing machine.

2. Description of the Prior Art

Continuous cumulative wire drawing machines can be classified as being either of the "single block" or "double block" types. In single block machines, as the term implies, at each drawing station the wire is drawn through a die by a single rotatably driven block. A segment of the wire is allowed to accumulate as multiple windings on the block before passing through a guide in the form of a pay-off eye on an overlying carrier ring which is freely rotatable about the block axis. From here, the wire continues over appropriately arranged guide sheaves either to another die at the next drawing station or to the final take-up block.

In double block machines, upper and lower blocks are arranged at each drawing station on a vertically disposed drive shaft. The lower block is keyed to the drive shaft for rotation therewith, and serves to draw the wire through the die. The upper block is freely rotatable on the drive shaft, and an independently rotatable carrier ring with a guide consisting of a transfer sheave is interposed between the two blocks. After passing through the die, wire accumulates on the lower block before passing over the transfer sheave onto the upper block where a further accumulation takes place. The wire then continues from the upper block over other appropriately positioned guide sheaves to the next station.

Under an ideal constant mass flow condition, i.e., when the mass flow rate at which wire is being wound onto the blocks equals the mass flow rate at which wire is being payed off the blocks, the carrier rings and their respective pay-off eyes or transfer sheaves will remain stationary. More often as not, however because of uneven die wear and/or other variable operating conditions, these rates will differ at one or more of the drawing stations. The carrier rings will compensate for differences between take-up and pay-off rates by rotating in either clockwise or counterclockwise directions, depending on whether the accumulations of wire on the blocks are increasing or decreasing.

There is, however, a limit to the extent to which such increases or decreases in wire accumulations can be tolerated. Thus, operating personnel must constantly monitor and adjust the wire accumulation on each block. Where the blocks are all connected via clutches to a common drive, as is usually the case, this entails frequent disengagement and reengagement of the clutches of selected blocks. This is a burdensome task, and one that requires considerable experience and a high degree of skill.

Moreover, when a clutch is disengaged to momentarily stop a selected block, the cooling time for the wire segment accumulated on that block will be extended as compared with the cooling times of the wire segments passing around those other blocks which continue to rotate. Any such localized extended cooling may produce a localized unacceptable variation in the metallurgical properties of the wire.

In the past, attempts have been made at alleviating the control responsibilities of operating personnel by providing systems designed to automatically monitor and adjust mass flow conditions. Typically, such systems employ vertically spaced pairs of photoelectric cells and light sources arranged to define the upper and lower limits of wire accumulation on the blocks. The signals generated by the photoelectric cells are used to automatically engage and disengage the clutches connecting the blocks to the common drive. While such systems can relieve operating personnel of some control responsibility, they still produce unacceptable localized variations in metallurgical properties caused by intermittent operation of the blocks. Moreover, such systems often malfunction as a result of the photoelectric cells becoming coated with the dust which usually pervades the atmosphere of a wire mill.

An object of the present invention is to provide an improved control system for maintaining a substantially constant mass flow rate of wire through the successive stations of a continuous cumulative wire drawing machine.

Another object of the present invention is to achieve the aforesaid substantially constant mass flow rate without imparting undesirable localized variations to the metallurgical properties of the wire as a result of uneven cooling.

Still another object of the present invention is the provision of a control system which can operate reliably in dust laden environments of the type often found in wire drawing mills.

SUMMARY OF THE INVENTION

In accordance with the present invention, each block is separately driven by a variable speed motor. Motion detectors generate electrical signals representative of the direction and speed of rotation of the carrier rings and their respective pay-off eyes or transfer sheaves. Controls responsive to such signals adjust the operational speeds of the drive motors in order to achieve a steady state operating condition where the mass flow rate of the wire being wound onto and paid off each block is substantially constant.

Preferably, the motion detectors are arranged adjacent to and spaced from the rotational path of the carriers.

In one preferred embodiment to be described hereinafter in more detail, the carrier comprises a ring having circumferentially spaced radially extending tooth-like projections. Each motion detector consists of a pair of proximity switches with sensing zones which extend across and which are spaced along the path of carrier rotation. Each proximity switch operates to generate a pulsed electrical signal indicating the presence of one of the radially extending carrier projections in its respective sensing zone. The time plots of the pulsed electrical signals of the sensors are indicative of both the direction and speed of rotation of the carrier.

In another embodiment also to be described hereinafter in more detail, each motion detector consists of a single completely encapsulated unit which senses movement of a continuous metal surface across its sensing face, and which creates a signal that can be interpreted into both speed and direction.

DESCRIPTION OF PREFERRED EMBODIMENTS

Figure 1:
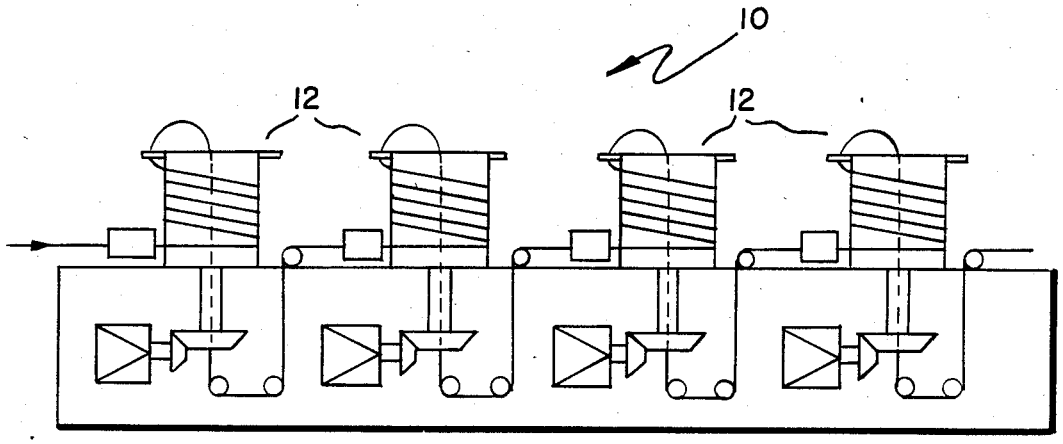
FIG. 1 is a schematic side elevational view of an accumulator-type multi-draft wire drawing machine, with single blocks at each station.
Figure 2:
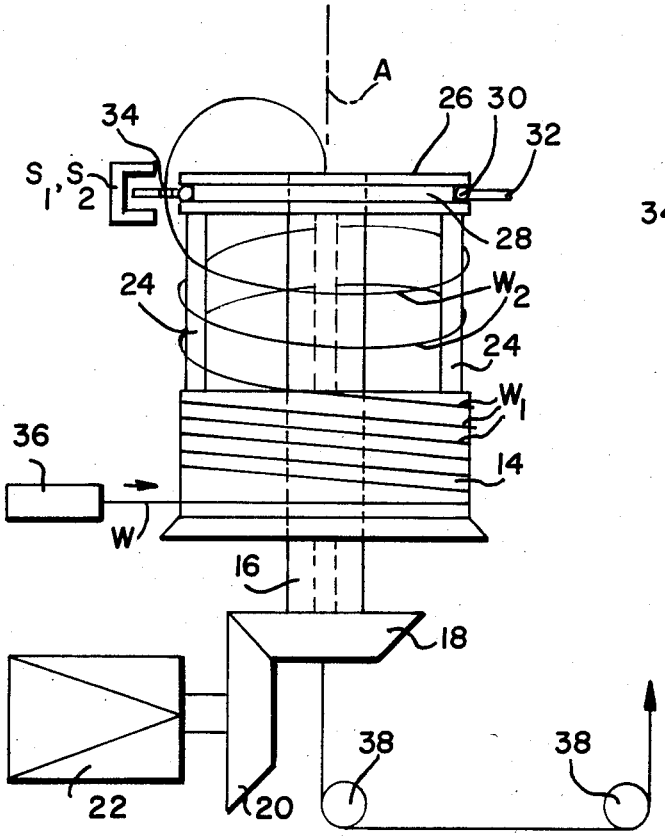
FIG. 2 is an enlarged side elevational view of one of the drawing stations of the machine shown in FIG. 1, and including components of a control system in accordance with the present invention.
Figure 3:
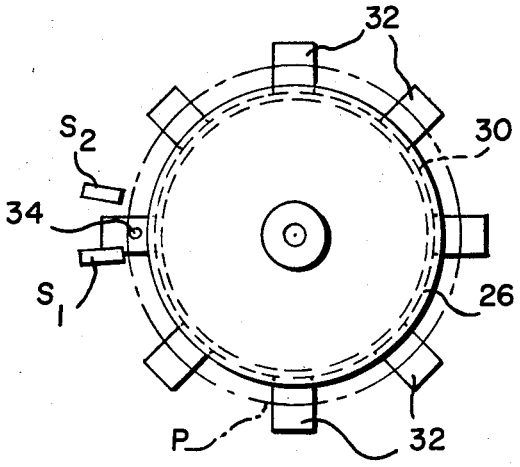
FIG. 3 is a top plan view of the station shown in FIG. 2.

Referring initially to FIG. 1, an accumulator-type, multi-draft wire drawing machine is shown at 10 comprising a plurality of drawing stations 12. As can be best seen in FIGS. 2 and 3, each station 12 includes a capstan-type block 14 keyed or otherwise fixed to a tubular drive shaft 16 for rotation about an axis "A". The shaft is driven via a set of bevel gears 18, 20 by a variable speed electrically powered drive motor 22.

A plurality of pins 24 extend vertically from the top of the block 14 to an upper rim 26 defining a circumferential outwardly facing groove 28. A carrier ring 30 is located in the groove 28 and is freely rotatable in relation to the block 14 and rim 26 about the axis A. The carrier ring has a plurality of radially extending arcuately spaced tooth-like projections indicated typically at 32, one of which is provided with a guide eye 34.

During a wire drawing operation, wire "W" is pulled through a die 36 by the rotatably driven block 14 around which a plurality of wire windings $w_1$ have been tightly wrapped. The wire leaves the block as loose windings $w_2$ surrounding the pins 24 and then passes upwardly through the guide eye 34. From here, the wire returns downwardly through the tubular drive shaft 16 and around guide sheaves 38 to the next wire drawing station.

If the rate $R_e$ at which wire is being pulled through the die 36 and wound onto the block 14 is the same as the rate $R_x$ at which wire leaves the block via guide eye 34, then the carrier ring 30 will remain motionless. However, if $R_x$ exceeds $R_e$, the carrier ring will rotate in a clockwise direction as viewed in FIG. 3 to decrease the windings on the block. By the same token, if $R_e$ exceeds $R_x$, the carrier ring will rotate in a counter clockwise direction (viewed from the same standpoint) to increase the windings on the block.

In order to sense and rapidly react to motion of the carrier ring in either direction, a pair of proximity switches $S_1$, $S_2$ are arranged adjacent to but spaced from the circular path "P" travelled by the carrier ring projections 32. The switches are spaced one from the other, and each has a sensing zone which extends across the path P. Preferably, the spacing between the switches $S_1$, $S_2$ is less than the width of the projections 32.

Figure 7A:
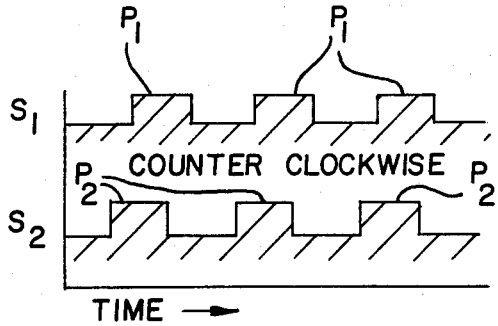
FIGS. 7A and 7B are time plots of the pulsed electrical signals of the sensors shown in FIGS. 2 and 3, respectively depicting clockwise and counterclockwise rotation of the carrier ring.
Figure 7B:
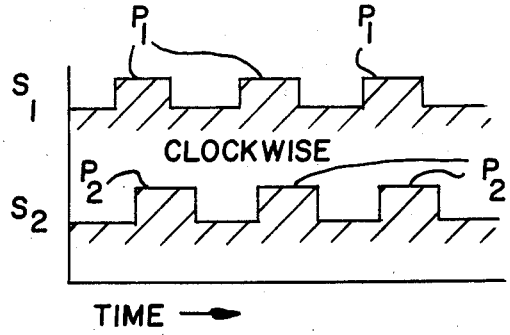

FIGS. 7A and 7B graphically depict the pulses generated by the switches $S_1$, $S_2$. As shown in FIG. 7A, during counterclockwise rotation of the carrier ring 30 as viewed in FIG. 3, the successive pulse plateaus $p_2$ of switch $S_2$ generated by the passing projections 32 precede the pulse plateaus $p_1$ of switch $S_1$. On the other hand, as shown in FIG. 7B, during clockwise rotation of the carrier ring as viewed in FIG. 3, the opposite is true, i.e., pulse plateaus $p_1$ precede pulse plateaus $p_2$. In both cases, the widths (durations) of the pulses are indicative of rotational speed of the carrier ring.

Figure 6:
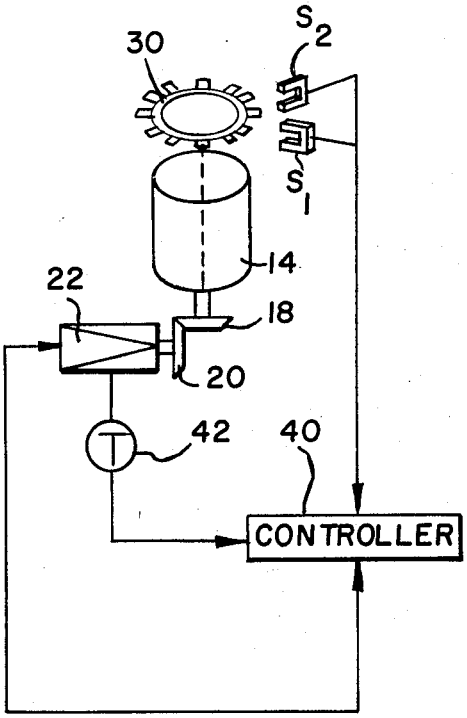
FIG. 6 is a schematic control diagram.

With reference to FIG. 6, it will be seen that the output signals of the switches $S_1$, $S_2$ are fed to a controller 40 which also receives the output signal from a tachometer 42 monitoring the speed of drive motor 22. These signals are processed by the controller and an appropriate control signal is then fed to the drive motor 22 to adjust the rotational speed of the block 14 in order to balance $R_e$ and $R_x$ and thereby return the carrier ring 30 to a stationary condition. Of course, the signal pulses of the switches $S_1$, $S_2$ can also be counted to provide an indication of the change of accumulation of wire on the block as a result of an unbalanced $R_e$, $R_x$ condition. The speed of motor 22 can be controlled to first return that accumulation to a predetermined optimum amount before again striking a balance between $R_e$ and $R_x$.

Figure 4:
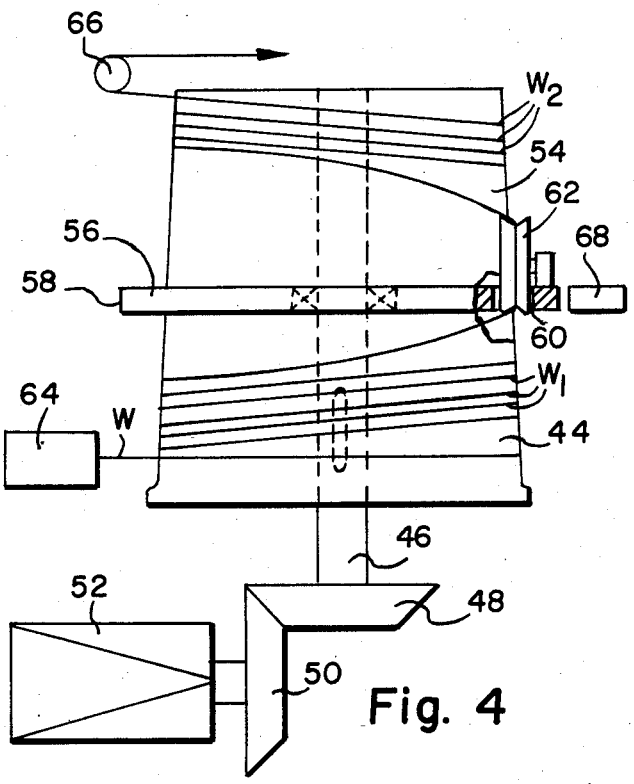
FIG. 4 is an enlarged side view of a double block station, again including components of a control system in accordance with the present invention.
Figure 5:
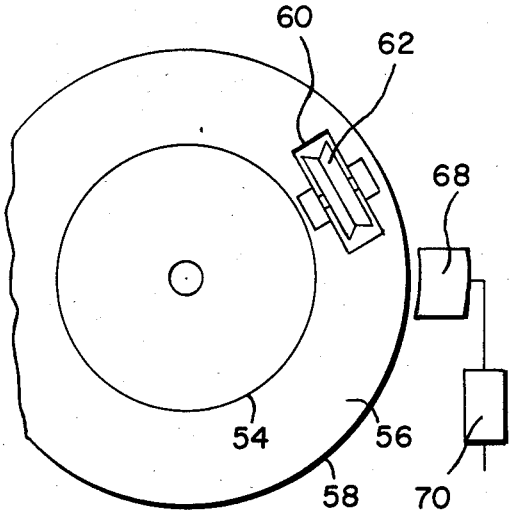
FIG. 5 is a partial top plan view of the station shown in FIG. 4.

FIGS. 4 and 5 show another embodiment of the invention as applied to a double block drawing station. Here, a lower block 44 is again keyed to a drive shaft 46, and the shaft is driven via a pair of intermeshed bevel gears 48, 50 by a variable speed drive motor 52. An upper block 54 is mounted on the shaft 46 and is rotatable thereon. Shaft 46 also carries a freely rotatable carrier ring 56 which is located between the two blocks 44, 54. The carrier ring has a circular periphery 58 and an opening 60 in which is located a rotatable guide sheave 62.

Wire W is drawn through a die 64, and after being tightly accumulated as windings $w_1$ on the lower block 44, is passed through the opening 60 and around the guide sheaves 62 before being accumulated as a plurality of windings $w_2$ on the upper block 54. From here, the wire passes over an appropriately positioned sheave 66 on its way to the next station.

Here again, if the rate $R_e$ at which wire is being taken onto the lower block 44 equals the rate $R_x$ at which wire is being removed from the upper block 54, the carrier ring 56 will remain motionless. If $R_x$ exceeds $R_e$, the carrier ring will rotate in a clockwise direction as viewed in FIG. 5 to diminish the accumulation of wire on the lower block 44 and to feed more wire to the upper block 54. Conversely, if $R_e$ exceeds $R_x$, the carrier ring will rotate in a counter clockwise direction to achieve the opposite result.

In this embodiment, carrier ring rotation is detected and monitored by a single transducer 68 which senses movement of the ring periphery across its sensing face and creates a signal which can be interpreted into both speed and direction by an associated output module 70. These signals are then employed in the manner previously described in connection with FIG. 6 to control the operational speed of the drive motor 52 and thereby restore and maintain a balance between $R_e$ and $R_x$.

Typically, the transducer 68 can be type RTI-S1 and the output module 70 type RT2, both being products of the Square D Company of Palatine, Ill., U.S.A.

In light of the foregoing, it will now be appreciated by those skilled in the art that the present invention provides a system for automatically observing both the speed and direction of rotation of the carrier rings on either single or double block machines. Based on such observations, the system automatically controls the operational speeds of the variable speed block drive motors in order to maintain a balance between $R_e$ and $R_x$ at each drawing station. The system of the present invention does not rely on mechanical connections or direct contact with the rotatable components of the drawing block, nor does it rely on light sensors as is typical with prior art arrangements. Most importantly, the system reacts immediately to any unbalance between $R_e$ and $R_x$, thereby avoiding substantial variations of wire accumulation from the desired norm at each drawing station.

We claim:

1. A wire drawing machine having a die and rotating block wherein wire is drawn through said die by said rotating block, said block being driven by a variable speed motor, the thus drawn wire being accumulated as a plurality of windings on the block before being removed therefrom via a guide, the guide being arranged on a carrier which rotates independently of the block about the axis of block rotation when a difference exists between the rates at which wire is wound onto and removed from the block, the improvement comprising: a control system including motion detection means arranged to coact with the carrier in generating electrical signals representative of the direction and speed of rotation of said carrier, and control means associated with said motor and said motion detection means and responsive to said signals for adjusting the rotational speed of said block in order to reach a steady state condition where wire is being wound onto and removed from said block at the same rate, and said carrier remains motionless.

2. The wire drawing machine of claim 1 wherein said motion detector means is arranged adjacent to and spaced from the rotational path of said carrier.

3. The wire drawing machine of claim 2 wherein said carrier comprises a ring having circumferentially spaced radially extending tooth-like projections, and wherein said motion detector means comprises a pair of proximity switches with sensing zones extending across and arcuately spaced along said rotational path, each of said switches being operative to generate a pulsed electrical signal indicating the presence of one of said projections in its respective sensing zone.

4. The wire drawing machine of claim 3 further comprising means for generating a time plot of the pulsed electrical signals of said sensors, said time plot being indicative both of the direction and speed of rotation of said carrier.

5. The wire drawing machine of any one of claims 1–4 wherein said carrier comprises a ring, and wherein said guide comprises an eye through which the wire is pulled from said block.

6. The wire drawing machine of any one of claims 1–4 further comprising a second block mounted for rotation on the same axis as and independently of the first mentioned block, said carrier being interposed between said blocks and said guide constituting a sheave over which wire is passed from said first mentioned block to be wound onto said second block.

* * * * *